US008833023B2

(12) United States Patent
Masure et al.

(10) Patent No.: US 8,833,023 B2
(45) Date of Patent: Sep. 16, 2014

(54) COMPOSITE PANEL FOR A WALL AND METHOD FOR MAKING SAME

(75) Inventors: David Masure, Chatenay Malabry (FR); Chantha Moum, Bussy Saint Georges (FR)

(73) Assignee: Arcelormittal Construction France, Rueil Malmaison (FR)

( * ) Notice: Subject to any disclaimer, the term of this patent is extended or adjusted under 35 U.S.C. 154(b) by 233 days.

(21) Appl. No.: 13/123,647

(22) PCT Filed: Mar. 11, 2009

(86) PCT No.: PCT/FR2009/050401

§ 371 (c)(1),
(2), (4) Date: Aug. 2, 2011

(87) PCT Pub. No.: WO2010/040921

PCT Pub. Date: Apr. 15, 2010

(65) Prior Publication Data

US 2011/0277407 A1 Nov. 17, 2011

(30) Foreign Application Priority Data

Oct. 10, 2008 (FR) ..... 08 56882

(51) Int. Cl.
*E04C 2/296* (2006.01)
*E04C 2/38* (2006.01)

(52) U.S. Cl.
CPC ..... *E04C 2/384* (2013.01); *E04C 2/296* (2013.01)
USPC ..... 52/309.7; 52/309.9; 52/309.14; 52/404.3; 52/406.3; 52/407.2; 52/578; 52/742.13; 52/794.1

(58) Field of Classification Search
USPC ..... 52/309.1, 309.2, 309.7, 309.9, 309.14, 52/309.16, 578, 589.1, 742.13, 404.1, 52/404.3, 406.1–406.3, 407.2, 407.3, 52/745.05, 745.09, 783.1, 794.1
See application file for complete search history.

(56) References Cited

U.S. PATENT DOCUMENTS

| | | | | |
|---|---|---|---|---|
| 1,818,704 | A * | 8/1931 | Frantz | 52/417 |
| 2,275,815 | A * | 3/1942 | Crandell | 52/417 |
| 2,324,971 | A * | 7/1943 | Woodward | 52/302.3 |
| 2,582,144 | A * | 1/1952 | Miles | 52/404.1 |
| 3,785,913 | A * | 1/1974 | Hallamore | 428/71 |
| 4,163,349 | A * | 8/1979 | Smith | 52/241 |
| 4,372,089 | A * | 2/1983 | Akesson | 52/404.3 |

(Continued)

FOREIGN PATENT DOCUMENTS

| | | |
|---|---|---|
| CA | 2 081 651 | 4/1994 |
| JP | 51-011608 | 1/1976 |

(Continued)

OTHER PUBLICATIONS

International Preliminary Report on Patentability, issued in corresponding International Application No. PCT/FR2009/050401.

(Continued)

*Primary Examiner* — Adriana Figueroa
(74) *Attorney, Agent, or Firm* — Kenyon & Kenyon LLP

(57) ABSTRACT

A composite panel for making a wall of a building includes an outer cladding plate, an inner wall plate, and a supporting structure provided between the outer cladding plate and the inner wall plate and which is partially embedded in a polymer foam.

30 Claims, 10 Drawing Sheets

(56) References Cited

U.S. PATENT DOCUMENTS

| | | | | | |
|---|---|---|---|---|---|
| 4,379,381 | A * | 4/1983 | Holcombe | 52/404.3 |
| 4,633,634 | A * | 1/1987 | Nemmer et al. | 52/474 |
| 4,937,993 | A * | 7/1990 | Hitchins | 52/455 |
| 5,067,296 | A * | 11/1991 | Brown et al. | 52/309.7 |
| 5,245,809 | A | 9/1993 | Harrington | |
| 5,297,369 | A * | 3/1994 | Dickinson | 52/281 |
| 5,349,796 | A * | 9/1994 | Meyerson | 52/309.11 |
| 5,389,167 | A * | 2/1995 | Sperber | 156/71 |
| 5,404,687 | A * | 4/1995 | Blake et al. | 52/600 |
| 5,444,955 | A * | 8/1995 | Ou | 52/309.9 |
| 5,524,400 | A * | 6/1996 | Schmechel | 52/474 |
| 5,743,056 | A * | 4/1998 | Balla-Goddard et al. | 52/309.11 |
| 5,758,463 | A * | 6/1998 | Mancini, Jr. | 52/309.12 |
| 5,765,330 | A * | 6/1998 | Richard | 52/309.13 |
| 5,787,651 | A * | 8/1998 | Horn et al. | 52/144 |
| 6,026,629 | A * | 2/2000 | Strickland et al. | 52/794.1 |
| 6,099,768 | A * | 8/2000 | Strickland et al. | 264/46.4 |
| 6,698,157 | B1 * | 3/2004 | Porter | 52/794.1 |
| 7,107,731 | B2 * | 9/2006 | Record | 52/309.9 |
| 7,127,858 | B2 * | 10/2006 | Layfield | 52/407.1 |
| 7,513,082 | B2 * | 4/2009 | Johnson | 52/144 |
| 7,543,419 | B2 * | 6/2009 | Rue | 52/630 |
| 7,574,837 | B2 * | 8/2009 | Hagen et al. | 52/404.1 |
| 7,662,469 | B2 * | 2/2010 | Schmidt et al. | 428/319.3 |
| 7,735,282 | B2 * | 6/2010 | Price | 52/408 |
| 7,866,105 | B2 * | 1/2011 | Babbitt et al. | 52/404.1 |
| 2004/0020148 | A1 * | 2/2004 | Thompson | 52/309.9 |
| 2006/0174586 | A1 * | 8/2006 | Morandi | 52/782.1 |
| 2006/0201089 | A1 * | 9/2006 | Duncan et al. | 52/309.8 |
| 2006/0207203 | A1 * | 9/2006 | Kennedy | 52/404.3 |
| 2007/0193215 | A1 * | 8/2007 | Jablonka | 52/782.1 |
| 2008/0250738 | A1 * | 10/2008 | Howchin | 52/235 |
| 2008/0295450 | A1 * | 12/2008 | Yogev | 52/783.1 |

FOREIGN PATENT DOCUMENTS

| | | |
|---|---|---|
| JP | 56-159457 | 12/1981 |
| JP | 64-041886 | 3/1989 |
| JP | 10-082121 | 3/1998 |
| JP | 10-131298 | 5/1998 |
| JP | 11-081525 | 3/1999 |
| JP | 11-172800 | 6/1999 |
| JP | 2001-241123 | 9/2001 |
| JP | 2002-285660 | 10/2002 |
| JP | 2003-302155 | 10/2003 |
| JP | 2007-046273 | 2/2007 |
| WO | 01/09451 | 2/2001 |
| WO | WO 2004/053250 | 6/2004 |
| WO | WO 2007/009173 | 1/2007 |

OTHER PUBLICATIONS

International Search Report, issued in corresponding International Application No. PCT/FR2009/050401.

* cited by examiner

COMPOSITE PANEL FOR A WALL AND METHOD FOR MAKING SAME

FIELD OF THE INVENTION

The present invention relates to a composite panel for making a wall of a building.

BACKGROUND INFORMATION

The outer walls of buildings, and in particular of buildings such as individual houses, are traditionally made up of concrete block walls assembled and supported by cement. This traditional construction technique has the drawback of requiring significant labor and calling on several building trades, which represents drawbacks in terms of the assembly time for such walls as well as the cost.

SUMMARY

Example embodiments of the present invention resolve these drawbacks by providing building wall elements that can be assembled easily, while having mechanical properties adapted to all of the constraints placed on the buildings.

To that end, example embodiments of the present invention provide a composite panel for making a wall of a building, including an outer cladding plate, an inner wall plate, and a supporting structure provided between the outer cladding plate and the inner wall plate, whereof the supporting structure is at least partially embedded in a polymer foam.

The panel can also include the following optional features, considered alone or in combination:

- the polymer foam is a polyurethane foam having a density greater than 30 $Kg/m^3$.
- at least one panel made from mineral wool is housed in the supporting structure.
- the supporting structure includes a metal frame including at least two side posts, an upper crosspiece, and a lower crosspiece.
- the side posts are made up of two C-shaped profiles that are alongside each other in different orientations relative to each other.
- the two C-shaped profiles each include a bottom connecting two parallel side wings and are arranged perpendicular to each other so that a side wing of one of the profiles is alongside the bottom of the other profile.
- the supporting structure includes a central post.
- the central post is made up of two C-shaped profiles alongside each other back to back.
- a mineral wool panel is arranged in the volume defined by the supporting structure, the ends of said panel being housed in the bottom of two facing C-shaped profiles of two adjacent posts.
- the upper and lower crosspieces are made up of U-shaped profiles covering the free ends of the side posts.
- the U-shaped profile that makes up the lower crosspiece includes a bottom that includes a longitudinal rib extending over the entire length of the profile.
- the frame includes a wind bracing.
- the wind bracing is a St Andrew's cross.
- alternatively the wind bracing is a metal plate secured to at least the side posts.
- the metal plate is also secured to the central post.
- the inner wall plate includes an outer plaster plate.
- the inner wall includes a steam-impermeable membrane alongside or secured to the inner or outer surface of the outer plaster plate.

- the panel includes a device for running cables inside the panel.
- in a first alternative, the panel includes a raceway for running cables extending over the height of the panel and located close to the outer plaster plate so as to make it easy to access to run cables.
- the raceway is incorporated into the supporting structure extending from the bottom of the U-shaped profile of the lower crosspiece to the bottom of the U-shaped profile of the upper crosspiece, the upper and lower crosspieces including openings allowing access to the inside of the raceway for running cables.
- in a second alternative, the panel includes a device for keeping the finishing plate at a certain distance from the outer wall plate on the side opposite the supporting structure, so as to define a volume for running cables between these two plates.
- the supporting devices are spacers made from C-shaped profiles whereof the branches of the C are secured to the finishing plate and the outer wall plate, respectively.
- at least one mineral wool panel is arranged in the volume for running cables between the finishing plate and the outer wall plate, the ends of the panel being housed in the bottom of two adjacent C-shaped profiles.
- a layer of rock wool is adhered to the outer cladding plate.
- the panel includes two side edges, and at least one of the two edges is configured to be able to cooperate with the side edge of an adjacent panel configured in a complementary manner.
- at least one of the two side edges includes a tab made from a fire-resistant material extending along a side edge of the outer plaster plate arranged against the inner wall of the plaster plate and extending beyond the side edge so that when the side edge of the panel cooperates with the complementary side edge of an adjacent panel, the plaster tab covers the seam between the respective outer plaster plates of the adjacent panels.
- at least one side edge is formed by the polymer foam gripped between the outer cladding plate and the inner wall plate.
- the outer plaster plate includes, on its outer face, at least one thinner strip retracted towards the inside of the panel extending over the entire height of the plaster plate along a side edge.
- along at least one of the two side edges, the outer cladding extends laterally beyond the supporting structure and the inner wall plate, over a distance adapted to cover the side edge of an adjacent panel perpendicular to the composite panel, the outer cladding being covered on the inner face with a polymer foam configured to be able to cooperate in a complementary manner with the side edge of the adjacent panel.
- along the lower edge of the panel, the outer cladding plate extends downwards beyond the lower edge of the supporting structure, so as to form a covering skirt.
- the outer cladding plate is a metal cladding plate, such as a lacquered galvanized steel cladding plate.

Example embodiments of the present invention provide a method for making a composite panel as previously defined, including at least the following steps:

at least one inner wall plate, on which a supporting structure is placed or secured, is arranged in a molding frame, side crosspieces with shapes complementary to those of the side edges of the panel to be made are positioned, polymer foam blocks placed on the inner wall plate or the supporting structure are positioned, an outer cladding panel placed on the foam blocks so that the outer cladding panel is at a certain distance from the supporting structure is positioned, the assembly thus formed is inserted into a conformator, the polymer foam is injected hot, and the panel is stripped after cooling.

Example embodiments of the present invention will now be described more precisely, but non-limitingly in light of the appended figures.

BRIEF DESCRIPTION OF THE DRAWINGS

FIG. 10 is a diagrammatic view of the shape of a female side edge of a composite panel.

FIG. 11 is a diagrammatic view of the shape of a male side edge of a composite panel.

FIG. 12 is a diagrammatic view of a female corner edge of a composite panel adapted to assemble two adjacent panels perpendicularly.

FIG. 13 is a diagrammatic view of a male corner edge of a composite panel adapted to assemble two adjacent panels perpendicularly.

FIG. 14 is a diagrammatic view of the edge of a composite panel adapted to install door frame elements in it.

FIG. 15 is a cross-sectional view of the assembly of two adjacent panels aligned with each other.

FIG. 16 is a diagrammatic cross-sectional illustration of the assembly of two adjacent panels arranged perpendicular to each other.

DETAILED DESCRIPTION

Figure 1:
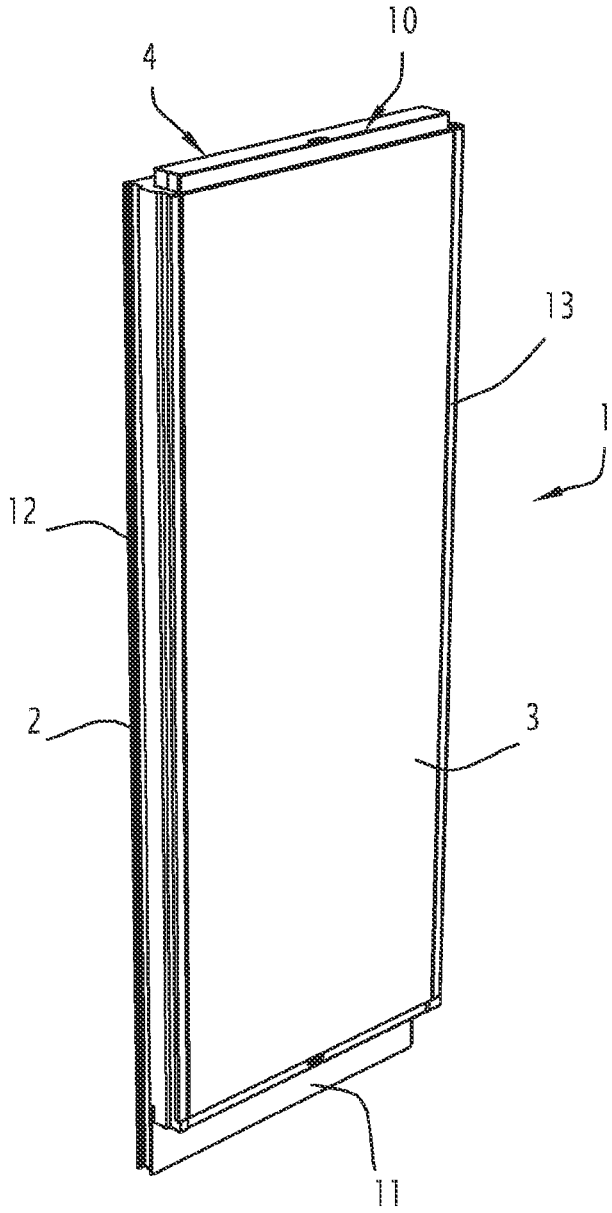
FIG. 1 is a perspective view of a composite panel intended to make a building wall element.

The composite panel, generally referenced 1 in FIG. 1, and which is generally rectangular, is made up of an outer cladding plate 2, an inner wall plate 3, and a supporting structure generally referenced 4 and provided between the outer cladding plate 2 and the inner wall plate 3.

The outer cladding plate 2 is for example a plate made from lacquered or pre-lacquered galvanized steel with a thickness for example between 0.5 mm and 1.5 mm. Such a lacquered metal cladding plate is known in itself. The inner wall plate 3 is, as better visible in FIG. 2, made up, for the outer part, of an outer plaster plate 431 whereof the thickness is for example between 10 mm and 25 mm. This plaster plate is either a plate made from normal plaster, or a plate made from fibrous plaster, or a hydrophobic plaster plate. In one alternative, it can include a steam-impermeable membrane.

Figure 3:
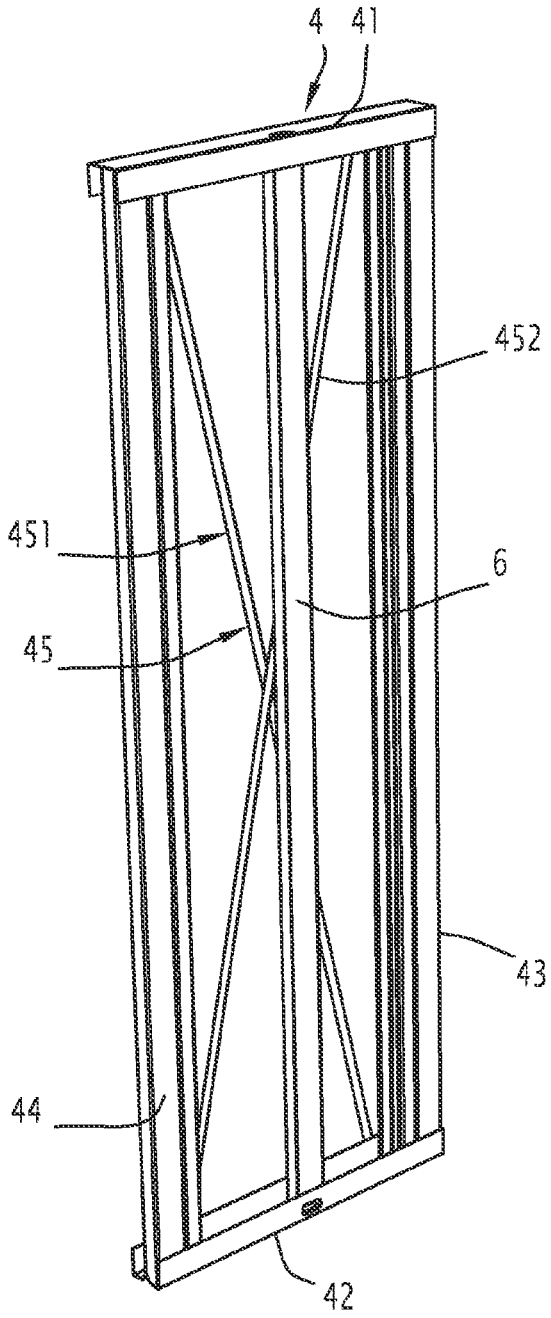
FIG. 3 is a perspective view of the supporting framework of the panel of FIG. 2 including a raceway for running cables.

In reference to FIG. 3, the supporting structure 4 is a metal frame including two vertical posts 43 and 44 connected to the upper portion by an upper crosspiece 41, and to the lower portion by a lower post 42. This metal frame comprises a wind bracing 45 made up of two tie rods 451 and 452 arranged in an X. This wind bracing is not essential. The upper crosspiece 41 of the metal frame is made up of a U-shaped profile. The lower crosspiece 42 is also made up of a U-shaped profile, the bottom of which comprises a longitudinal rib 421 extending over the entire length of the profile. This rib is intended to ensure good centering and maintenance of the bottom of the panel on a support structure that can be formed by a profile with a U-shaped section whereof the bottom also includes a longitudinal rib with an adapted shape. This support structure of the panel is not shown.

Figure 2:
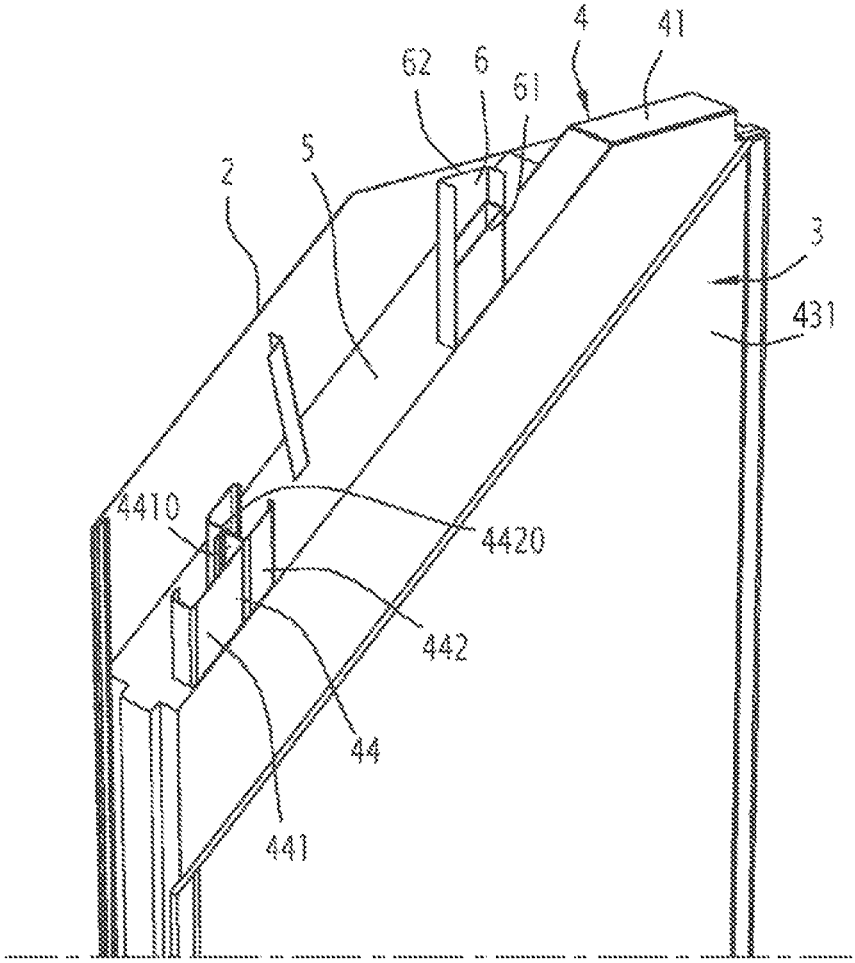
FIG. 2 is a perspective view in partial cross-section of the panel of FIG. 1 according to a first example embodiment.

Each of the posts 43, 44 is formed, as shown in FIG. 2 for a post 44, by two profiles 441 and 442 with a C-shaped section which are longitudinally alongside each other and oriented in perpendicular directions such that the wing 4410 of the profile 441 bears in contact on the bottom 4420 of the profile 442. In this example, the opening of the outermost profile 441 faces the outer cladding plate 2, and the opening of the innermost profile 442 faces the inside of the panel, but other arrangements are possible.

The different profiles and the wind bracing elements of the frame are for example formed by galvanized or non-galvanized steel, with a thickness preferably between 1.5 and 3 mm, and are for example assembled by spot welding.

Moreover, and as shown in FIGS. 2 and 3, a raceway 6 for running cables is inserted into the supporting frame. This raceway is made up of a sheath 61 with a rectangular section gripped in a U-shaped mechanical profile 62 intended to protect the sheath 61, which is made from polymer.

Figure 4:
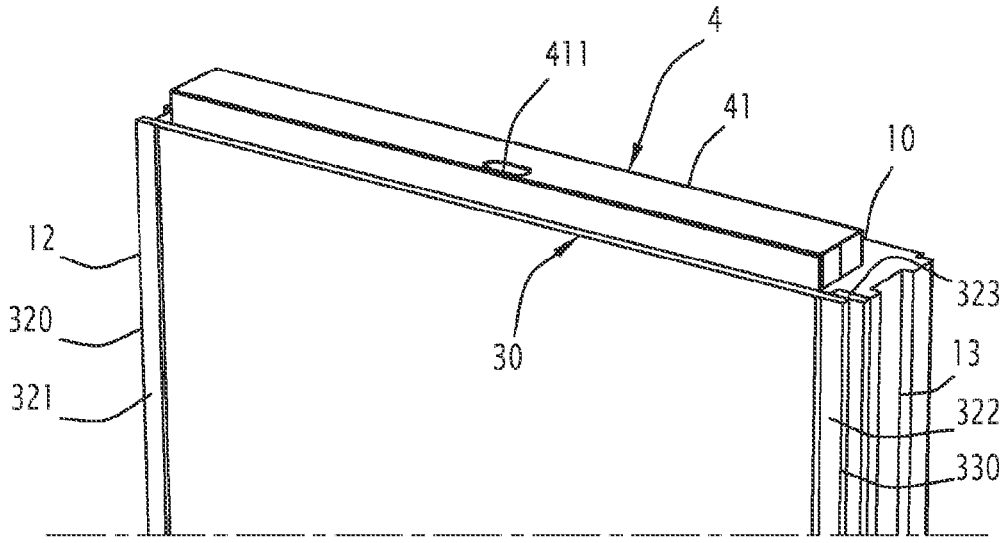
FIG. 4 is an enlarged perspective view of the upper portion of the panel of FIG. 1.
Figure 5:
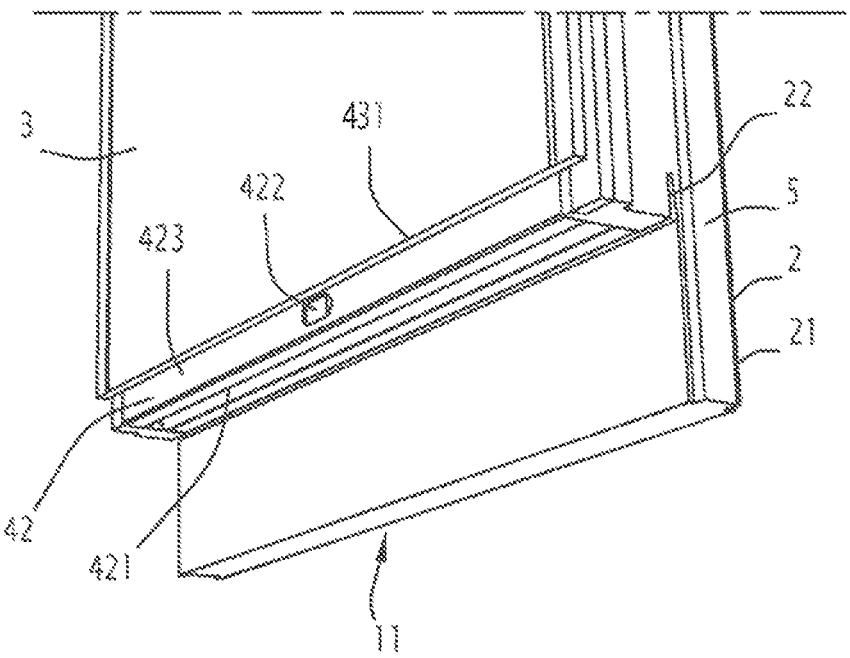
FIG. 5 is an enlarged perspective view of the lower portion of the panel of FIG. 1.

As shown in FIGS. 4 and 5, the raceway 6 for running cables emerges at the upper portion of the panel via the opening 411 provided on the upper surface of the upper crosspiece 41, and the lower portion of the panel via the opening 422 provided in the side wall of the lower crosspiece 42.

In order to ensure the connection of the assembly and also to obtain satisfactory mechanical strength of the panel, the supporting structure 4 is embedded in a polymer foam 5 which is, for example and preferably, polyurethane foam whereof the density is preferably greater than 30 $Kg/m^3$, and better between 40 $Kg/m^3$ and 50 $Kg/m^3$. Moreover, the foam is chosen so that its coefficient $\lambda$ of thermal conductivity is less than 0.035 $W/m^2 \cdot K$. The polyurethane foam, in which the supporting structure is embedded, comes into contact with the inner wall plate and into contact with the outer cladding plate such that the inner cladding and inner wall plates are glued by this foam and thus form a panel whereof the various components are integral with each other.

Due to the presence of this high-density polymer foam 5, the mechanical strength of the panel is considerably increased relative to panels with an identical shape but not comprising a polymer foam 5. Indeed, for a panel with a height between 2 meters and 4 meters and a width between 900 mm and 1m50, for example, and the thickness of which is between 150 mm and 300 mm, the resistance to longitudinal compression forces allows it to react a vertical load greater than 300 kN, whereas a panel whereof the framework is not embedded in foam can only react a distributed load in the vicinity of 40 kN.

Moreover, such a panel can bear a load distributed on its outer surface in the vicinity of 60 kN.

Moreover, the upper and lower edges of the panel, as well as the side edges, have shapes adapted to allow the assembly of the panels in a structure.

Thus, along the upper edge 10 of the panel, the upper crosspiece 41, i.e. the upper edge of the supporting structure, extends upwards beyond the upper edge 30 of the inner wall plate 3 as well as beyond the upper edge of the outer cladding plate 2. This arrangement allows fitting in a suitable structure with a shape complementary to the shape of the upper crosspiece 4.

In the lower portion 11 of the panel, the lower crosspiece 42, i.e. the lower edge of the supporting structure, extends beyond the lower edge 31 of the inner cladding plate 3, which leaves available space 423 to arrange a transverse raceway for running cables in which the connecting opening 422 with the raceway for running cables incorporated into the panel emerges. Moreover, the outer cladding plate 2, as well as its polymer foam coating, extends downwards beyond the lower crosspiece 42, i.e. the lower edge of the supporting structure, so as to form a covering skirt 21 that for example makes it possible to cover the edge of a lower support structure of the panel. Furthermore, along the lower crosspiece 42, on the side opposite the outer cladding plate 2, the polymer foam 5 includes a slot 22 that extends over the entire width of the panel and is adapted to receive, for example, the wing of a profile making up a bearing structure of the lower surface of the lower crosspiece 42 of the supporting structure of the panel. Thus, this slot allows assembly and proper fastening of the panel on a wall element.

Figure 6:
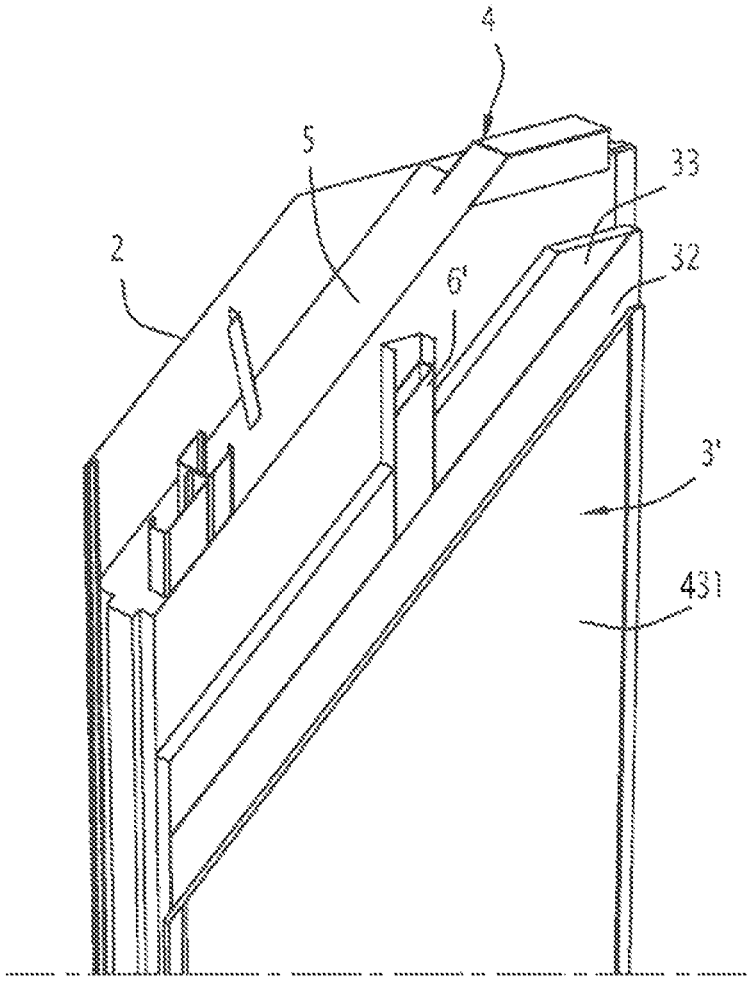
FIG. 6 is a cross-sectional perspective view of a second example embodiment of a composite panel for making a wall of a building.

The panel just described includes an inner wall plate made up of a plaster plate. However, it may be desirable to improve the insulation capacity, in particular stereophonic, of such a wall. To that end, it is possible to provide, as shown in FIG. 6, an inner wall plate 3' that includes a plaster plate 31 and a layer of fibrous material such as glass wool or rock wool 33 that, preferably, has a high density so as to improve the stereophonic insulation.

Moreover, a steam-impermeable membrane 32, also called vapor barrier, is adhered on the inner surface of the outer plaster plate. This membrane, which is not essential, is for example made up of an aluminum sheet.

The layer of fibrous material can have a thickness between 10 and 50 mm, each 10 mm slice of glass or rock wool increasing the transmission loss value by 1 decibel. In that case, and as shown in the figure, the raceway 6' is no longer incorporated into the framework in the supporting structure 4 of the composite panel, but is inserted inside the layer of fibrous material. As a result, the top and bottom of the panel are adapted so that this raceway emerges in a zone where it is possible to run cables at a distance relatively close to the plaster plate.

Figure 7:
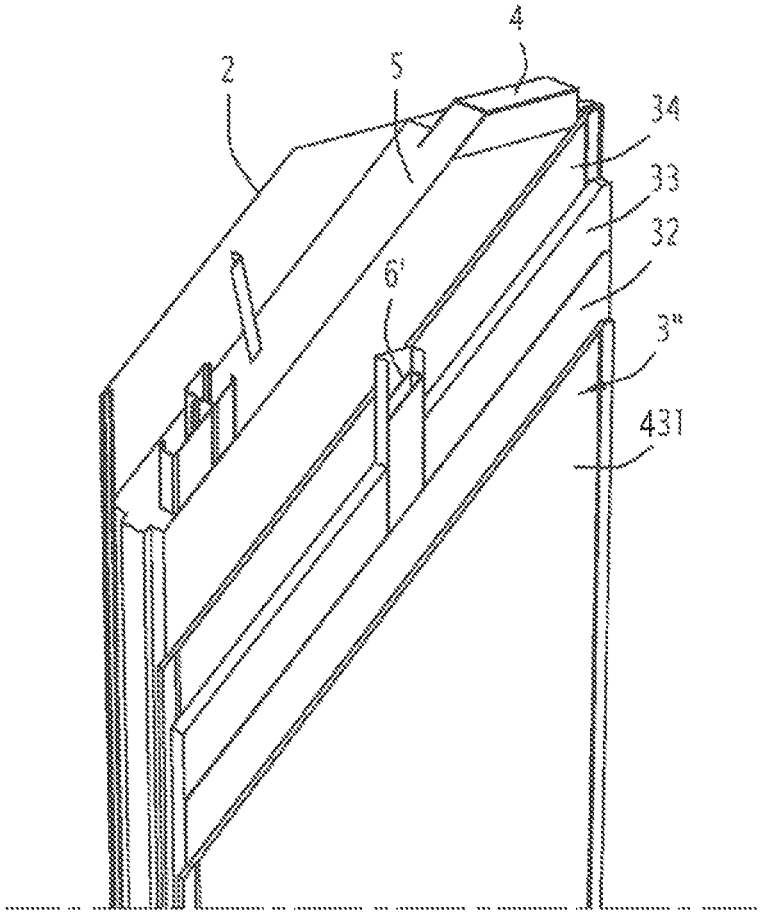
FIG. 7 is a partial cross-sectional perspective view of an alternative of the second example embodiment of a composite panel for making a wall of a building.

The two panels just described, with or without fibrous material, are well suited to making walls for single-family homes. However, to make multi-family homes, i.e. including several adjacent residences, it may be desirable to increase the properties, in particular the fire resistance of the walls. To that end, as shown in FIG. 7, the inner wall plate 3" includes, as in the previous case, an outer plaster plate 431, an impermeable membrane 32, a layer of fibrous material in which a raceway 6 is inserted, and lastly a complementary inner plaster plate 34.

For such panels, the fire performance was evaluated and is in the vicinity of 30 nm of resistance for a normalized fire. The conductivity of the base panel, i.e. without rock or glass wool, is 0.248 $W/m^2 \cdot K$.

Moreover, it will be noted that the plaster tabs 323, 323B intended to cover the seams of two adjacent panels in order to improve the fire resistance of an assembly of panels, are not necessarily made from plaster. These tabs may be made up of any material having fire resistance properties at least equal to those of the plaster, and preferably easier to implement than plaster. Thus, the tabs are fire resistant tabs.

Figure 8:
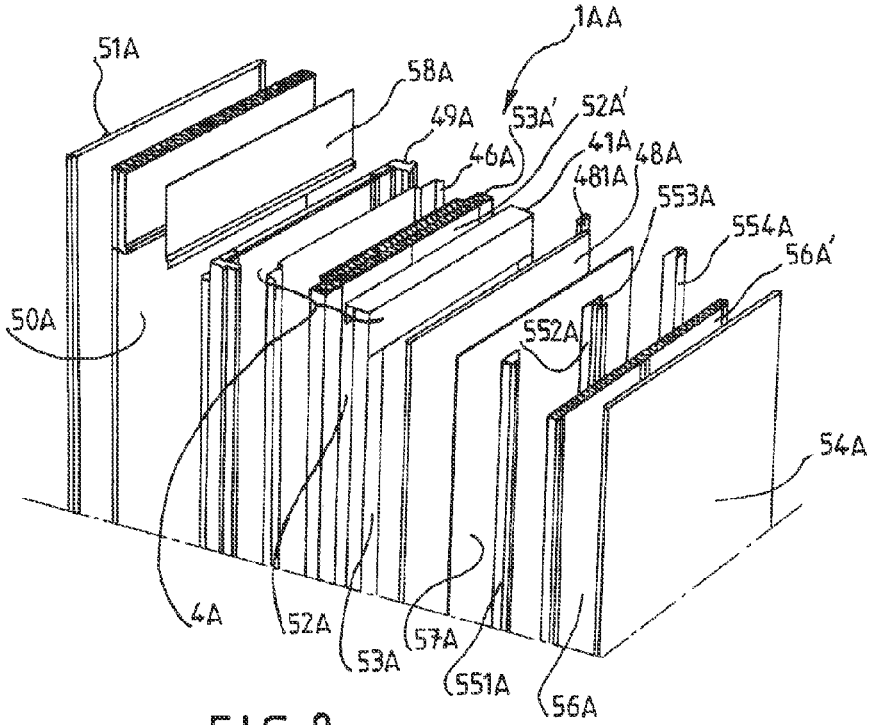
FIG. 8 is an exploded perspective view of the upper portion of a composite panel according to a third example embodiment.
Figure 9:
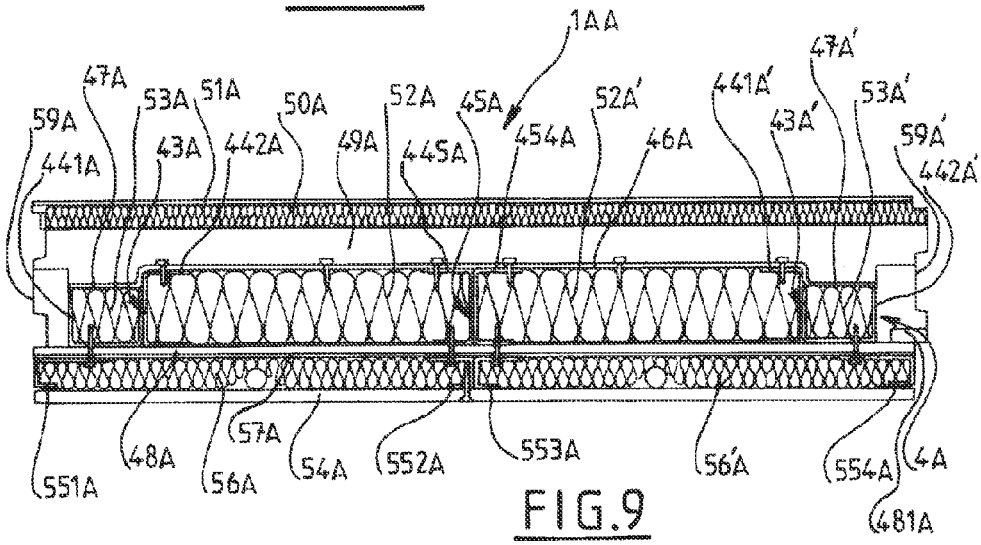
FIG. 9 is a cross-sectional view of the panel of FIG. 8.

We will now refer to FIGS. 8 and 9, which show an example embodiment having improved performance, acoustics, fire resistance, thermal resistance, and mechanical strength.

In this panel 1AA, the supporting structure 4A includes a metal frame including two side vertical posts 43A, 43A' and a central vertical post 45A that are connected at their upper portions by an upper crosspiece 41A and a lower crosspiece not shown in the figures.

The side vertical posts 43A, 43A' are each respectively made up of two profiles 441A, 442A; 441A', 442A' positioned in the same manner as the profiles 441 and 442 of the supporting structure 4 of FIGS. 2 and 3.

The central vertical post 45A is made up of two C-shaped profiles 445A, 454A bearing in contact back to back.

The supporting structure 4A also includes a metal wind bracing plate 46A secured to the side vertical posts 43A, 43A' and the central vertical post 45A, for example by screwing. This metal wind bracing plate 46A is substantially planar and has, at each of its ends, a recess 47A, 47A' so as to fit the recess formed by bringing the profiles 441A, 442A; 441A', 442A' of the side vertical posts 43A, 43A' alongside each other.

This supporting structure 4A is secured, for example by screwing, to a plaster plate 48A of the same nature as that of the first two example embodiments, also including a tab 481A corresponding to the tab 323 previously described and thereby making up the inner wall plate.

The supporting structure 4A is embedded in the polyurethane foam 49A, also of the same nature as that previously described, which comes into contact with the plaster plate 48A at the side edges of the panel 1AA.

On the side opposite the plaster plate 48A, the polyurethane foam 49A, with a thickness of about 7 cm, is in contact with a layer of rock wool 50A that is stuck to the outer cladding plate 51A. Between the rock wool 50A and the polyurethane foam, metal protective plates 58A are provided at the upper and lower ends of the panel that protect the rock wool and increase the strength of the skirt.

Within the supporting structure 4A, two rock wool panels 52A, 52A' are each inserted between two facing profiles of two adjacent posts, such that the two ends of each of the two rock wool panels 52A, 52A' are housed in the bottom of two facing profiles 442A, 445A; 454A, 441A'.

Furthermore, two strips of rock wool 53A and 53A' are respectively slid into each C-shaped profile 441A, 442A' of the side vertical posts, which are oriented towards the outer metal cladding 51A.

In this example embodiment, the cables are not run in a raceway, but in a space provided between the plaster plate 48A secured to the supporting structure 4A that is kept at a certain distance from a plaster finishing plate 54A using spacers 551A, 552A, 553A, 554A secured to two plaster plates 48A and 54A.

Among the four spacers 551A, 552A, 553A, 554A each in the shape of a C, two central spacers 552A, 553A bear in contact back to back and two side spacers 551A, 554A are each arranged at one end of the plaster plates 48A and 54A, while being oriented towards the central spacers 552A, 553A.

This configuration makes it possible to insert, between the two plaster plates 48A and 54A, two glass wool panels 56A, 56A' whereof each end is housed in the bottom of two adjacent and facing U-shaped spacers.

Each spacer 551A, 552A, 553A, 554A is asymmetrical in that the branch of the C of each spacer that is against the plaster plate 48A secured to the supporting structure 4A is longer than the branch secured to the plaster finishing plate 54A. This configuration makes it possible to screw, in a single operation, the spacers 551A, 552A, 553A, 554A on the side of their longest branch, a vapor barrier sheet 57A, and the plaster plate 48A to the supporting structure 4A without being bothered by the opposite branches of the spacers.

In this manner, the cables can be inserted into the rock wool panels. If the position of the switch is not known before assembly, the cables will be slid on the worksite into the rock wool panels up to the desired point. If the position of the switch is, however, known, the cables will be suitably installed and may emerge in a space formed in the plaster finishing plate 54A to receive a switch that will be mounted on the worksite.

The insertion of the mineral wool panels into the supporting structure is completely advantageous, since it makes it possible to group together, in a same volume, the functions unique to the mineral wool and the supporting structure, while participating in the mass-spring-mass effect for the acoustical resistance. This advantage can be transposed to the insertion of mineral wool panels between the spacers, the possibility of sliding the cables into the wool being added to the other advantages.

In this manner, a panel is obtained having a suitable thickness and for which all of the properties required to build multi-story single-family and multi-family homes are high performing.

The mechanical strength of the panel is imparted mainly by the supporting structure 4A, which is embedded in the polyurethane foam.

Furthermore, this supporting structure has several advantages.

First, the posts impart vertical stability and their C shape allows the mineral wool panel to be inserted into the thickness of the supporting structure with the previously mentioned advantages. In this respect, it is possible to provide only side posts and no central post. This would then result in the presence of a single rock wool panel.

Furthermore, using a metal plate as the wind bracing element makes it possible to give this plate, in addition to the wind bracing function, an anti-housebreaking function.

Moreover, the vapor barrier sheet 57A participates in the wind bracing and the outer cladding plate 51A also participates in the mechanical strength of the panel.

The fire resistance is imparted mainly by the plaster plate 48A secured to the supporting structure 4A and its firewall tab 481A, the plaster finishing plate 54A as well as the joint presence of the rock wool layer 50A adhered to the outer cladding plate 51A (outer fire performance) and the panels 52A, 52A' and strips 53A, 53A' of rock wool positioned in the supporting structure 4A.

The thermal insulation comes from the polyurethane foam, the panels 52A, 52A' and strips 53A, 53A' of rock wool positioned in the supporting structure 4A and the rock wool layer 50A adhered to the outer cladding plate 51A.

Regarding acoustic performance, the presence of three layers of mineral wool between which dense materials are located makes it possible to optimize the mass-spring-mass effect and to impart good acoustic performance.

It will also be noted that the rock wool layer 50A adhered to the outer cladding plate 51A is stiff enough to ensure the flatness of the outer cladding plate 51A.

All of the performances, and in particular the thermal insulation, must be kept at a maximum at the seam between two adjacent panels. This is why the edges of the panels are configured in a particular manner.

As previously indicated, the side edges 12, 13; 59A, 59A' of the panel according to any of the example embodiments previously described are configured so as to allow assemblies of adjacent panels. To that end, the edges of the panels are configured so as to have either male or female shapes, and complementary to each other so that a male edge of one panel can adapt on a female edge of another panel. Moreover, male and female edges are provided making it possible to assemble panels in a same plane or perpendicular panels.

For clarity, the references used in the continuation of the description are those that appear in FIGS. 1 to 7. Of course, all of the configurations shown in FIGS. 10 to 16 apply by analogy to the panel of FIGS. 8 to 9.

Figure 10:
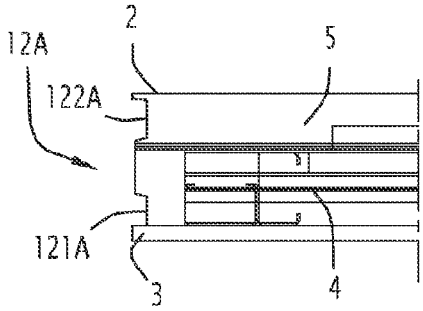
FIGS. 10 to 16 show side edges and different assemblies between composite panels according to any one of the first two example embodiments. The side edges and assemblies shown can be transposed to the panel of the third example embodiment.

FIG. 10 shows a female edge 12A of a panel that substantially includes two grooves 121A and 122A extending over the entire height of the panel, the groove 121A being bordered by the inner wall plate 3 and the groove 122A being arranged on the side of the outer cladding plate 2. These grooves are provided in the polymer foam 5 in which the framework of the panel is embedded.

Figure 11:
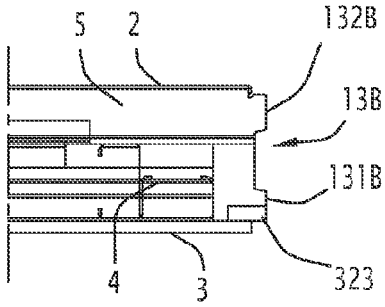

The male edge 13B, shown in FIG. 11, includes ribs 131B and 132B protruding towards the outside of the panel so as to form a shape complementary to the shape of the female edge 12A, so that a male edge can fit into a female edge.

Moreover, and as also shown in FIG. 4, on the side of the male edge, the panel includes a plaster tab 323 that extends over the entire height of the side edge of the corresponding outer plaster plate 3 and which laterally protrudes outwards. This plaster tab is intended to cover the seam of the inner wall plates of two adjacent panels. This covering is necessary to improve the fire resistance of these panels.

Moreover, along the side edges of the plaster plate, a thinner strip 321 or 322 extends over the outer surface of the panel, retracted towards the inside of the panel. This thinner strip extending over the entire height of the plaster plate along a side edge is intended to receive tape making it possible to hide the seam between two plaster plates of adjacent panels.

In order to be able to make corner assemblies, the panels can also include male or female corner edges.

Figure 12:
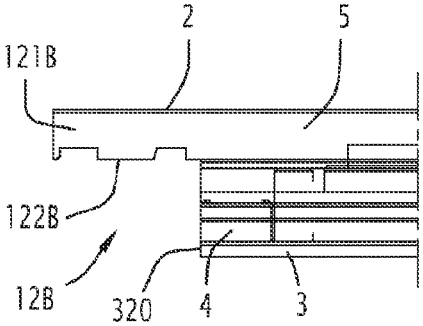

FIG. 12 shows a female corner edge 12B in which the outer cladding plate 2, as well as the polymer foam 5 that covers it, extends outwards beyond the edge 320 of the inner wall plate and the edge of the supporting structure 4 of the panel.

The portion 121 B of the outer cladding plate and its polymer foam coating 5 that extends beyond the side edge of the inner wall plate, has one surface 122B facing the inside of the panel that is configured to have a shape complementary to a male edge of a panel as previously described. To that end, this portion 121B includes grooves that extend over the entire height of the panel and that have shapes identical to those of the grooves of the female edges previously described.

Figure 13:
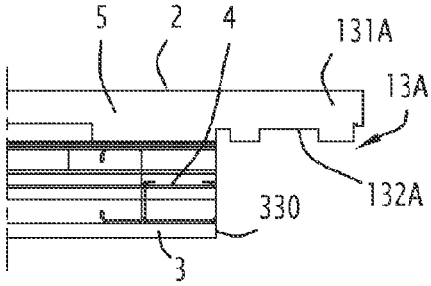

As shown in FIG. 13, a panel can also include a male corner edge 13A in which the outer cladding plate 2 as well as its polymer foam coating 5 extends laterally beyond the side edge 330 of the inner wall plate 3. This portion 131A of the outer cladding plate and its coating that extends beyond the edge of the inner wall plate, has an inner face 132A configured to be complementary to a female edge as described above.

In the two cases of corner edges, male or female, the outer cladding plates that extend beyond the side edge of the inner wall plate, extend laterally over a distance suitable for covering the edge of an adjacent panel perpendicular to the composite panel.

Figure 15:
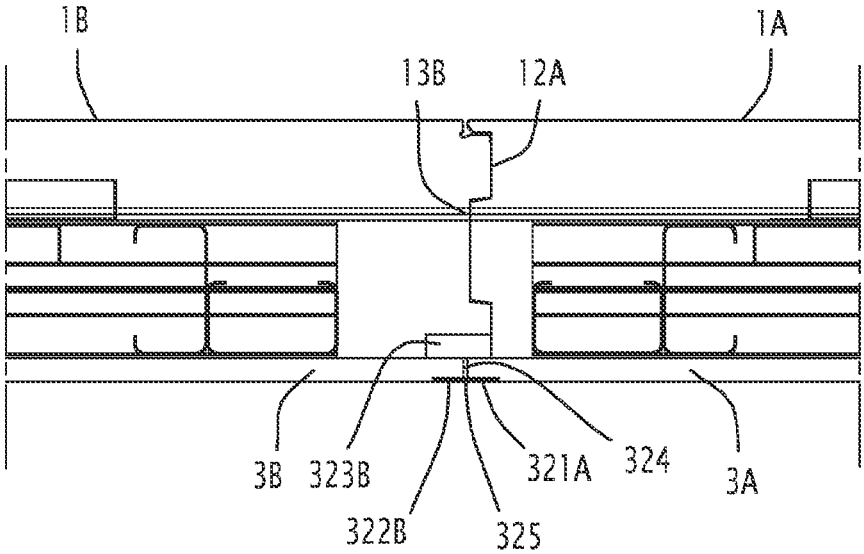

FIG. 15 shows a cross-sectional view of a seam between two panels 1A and 1B aligned with each other and in the same plane, panel 1A having a female edge 12A and panel 1B having a male edge 12B. As previously stated, the male and female edges 12B and 12A are complementary so that they fit together. As shown in the figure, at the seam between the two inner wall plates 3A and 3B of the panels 1A and 1B, the connecting line 324 between each of these two panels is covered by a plaster tab 323B provided on the male edge 12B side of the panel 1B. Likewise, this connecting line is camouflaged by a camouflage stick 325 inserted or glued in the groove formed by the two thinner zones 321A and 322B provided on the edges of the plaster plates of the inner wall plates of the two panels 1A and 1B.

Figure 16:
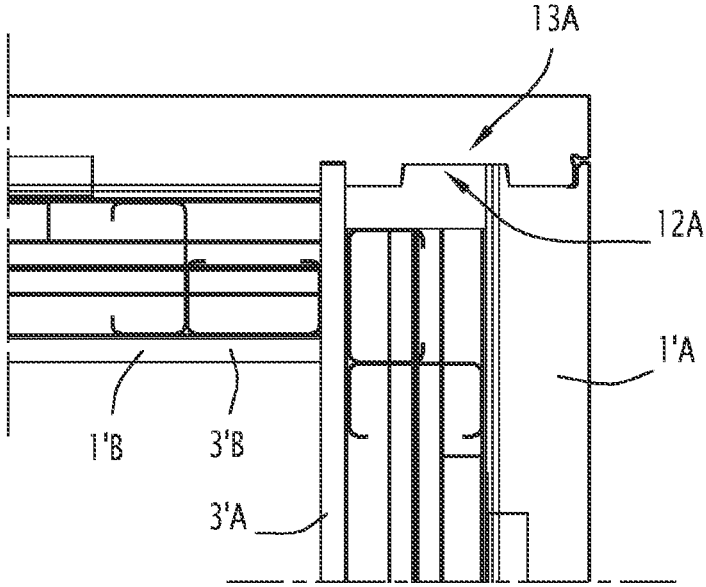

FIG. 16 shows a corner assembly of a panel 1'A having a female edge 12A fitting in a male corner edge 13B of a panel 1'B. As shown in the figure, the two inner wall plates 3'A and 3'B come into contact with each other. It will be noted that this corner assembly of panels perpendicular to each other can also be done with one panel having a male edge and one panel having a female corner edge, the male edge of one of the panels then fitting into the female corner edge of the other panel.

Figure 14:
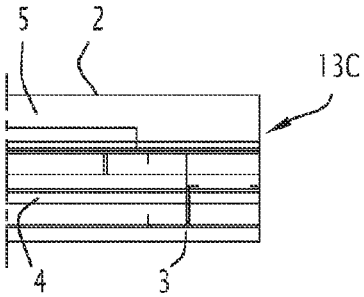

Lastly, and as shown in FIG. 14, the panel can include a straight edge 13C whereof the surface is planar and that is intended to receive door frame elements that can be placed against this edge and that can be fastened on this edge by different devices such as screws or glue.

The general principle for manufacturing a composite panel according to example embodiments of the present invention is as follows. At least the inner plaster plate, on which the supporting structure is placed or has been secured beforehand, is positioned in a mold frame. Side crosspieces with shapes complementary to those of the side edges of the panel to be made are positioned in this same frame. Polymer foam blocks are positioned on the supporting structure 4A or on the plaster plate in the case of the first two example embodiments and the outer cladding panel is placed on the foam blocks.

In the case of the third example embodiment of FIGS. 8 and 9, a rock wool layer 50A will have previously been glued on the inner surface of the outer cladding plate 51A before this wool layer-outer cladding plate assembly is placed on the foam blocks.

The assembly thus formed is introduced into a conformator, in which polymer foam is injected hot, and the panel is stripped after cooling.

Regarding the embodiment of FIGS. 8 and 9, before any operation in the molding frame, the profiles of the supporting structure are secured to the wind bracing plate 46A by screwing and the panels and rock wool strips are slid into the supporting structure 4A as described in reference to these two figures.

Then, the spacers, the vapor barrier sheet, and the outer plaster plate are all secured in a same screwing operation to the supporting structure 4A and more particularly to four of the profiles of the supporting structure.

Then, the glass wool panels are positioned between the spacers and the plaster finishing plate on at least one of the spacers.

This assembly is then positioned in the mold frame and the molding operation is done as previously described.

The invention claimed is:

1. A composite panel for making a wall of a building, comprising:

an outer cladding plate;

an inner wall plate;

a supporting structure provided between the outer cladding plate and the inner wall plate and at least partially embedded in a polymer foam, a first side of the supporting structure facing the inner wall plate is secured to the inner wall plate;

at least one panel made from mineral wool housed in the supporting structure;

wherein the polymer foam includes a polyurethane foam having a density greater than 30 $Kg/m^3$;

wherein the supporting structure includes a metal frame including at least two side posts, an upper crosspiece, and a lower crosspiece;

wherein the supporting structure is covered with the polyurethane foam on a second side facing the outer cladding plate, the polyurethane foam extending to lateral sides of the supporting structure, extending between the first and the second sides of the supporting structure; and wherein on a side opposite the supporting structure, the polyurethane foam is in contact with a layer of mineral wool which is glued to the outer cladding plate.

2. The composite panel according to claim 1, wherein the side posts include two C-shaped profiles that are alongside each other in different orientations relative to each other.

3. The composite panel according to claim 2, wherein the two C-shaped profiles each include a bottom web connecting two parallel side wings and are arranged perpendicular to each other so that one of the side wings of one of the profiles is alongside the bottom web of the other profile.

4. The composite panel according to claim 1, wherein the supporting structure includes a central post.

5. The composite panel according to claim 4, wherein the central post includes two C-shaped profiles alongside each other back to back.

6. The composite panel according to claim 1, wherein the ends of the mineral wool panel arranged in a volume defined by the supporting structure are housed in a bottom between webs of at least two facing C-shaped profiles of two adjacent posts, each of said at least two adjacent posts comprising a C-shaped profile, said at least two adjacent posts including (a) the side posts; and/or (b) one of the side posts and a central post.

7. The composite panel according to claim 1, wherein the upper and lower crosspieces include U-shaped profiles covering free ends of the side posts.

8. The composite panel according to claim 7, wherein the U-shaped profile that makes up the lower crosspiece includes a bottom that includes a longitudinal rib extending over an entire length of the profile.

9. The composite panel according to claim 1, wherein the frame includes a wind bracing.

10. The composite panel according to claim 9, wherein the wind bracing includes a St Andrew's cross.

11. The composite panel according to claim 9, wherein the wind bracing includes a metal plate secured to at least the side posts.

12. The composite panel according to claim 11, wherein the metal plate is also secured to a central post.

13. The composite panel according to claim 1, wherein the inner wall plate includes an outer plaster plate.

14. The composite panel according to claim 13, wherein the inner wall plate includes a steam-impermeable membrane alongside or secured to an inner or an outer surface of the outer plaster plate.

15. The composite panel according to claim 1, further comprising a device adapted to run cables inside the panel.

16. The composite panel according to claim 15, wherein the device includes a raceway adapted to run cables extending over a height of the panel and located close to an outer plaster plate so as to make it easy to access to run cables.

17. The composite panel according to claim 16, wherein the raceway is incorporated into the supporting structure extending from a bottom of a U-shaped profile of the lower crosspiece to a bottom of a U-shaped profile of the upper crosspiece, the upper and lower crosspieces including openings allowing access to an inside of the raceway.

18. The composite panel according to claim 1, further comprising a finishing plate kept at a certain distance from the inner wall plate on a side opposite the supporting structure by a spacing device, so as to define a volume to run cables between the inner wall plate and the finishing plate.

19. The composite panel according to claim 18, wherein the device is comprised of spacers made from C-shaped profiles, branches of the C-shaped profiles are secured to the finishing plate and the inner wall plate, respectively.

20. The composite panel according to claim 19, further comprising at least one mineral wool panel arranged in a volume for running cables between the finishing plate and the inner wall plate, ends of the mineral wool panel being housed in a bottom web of two adjacent two of said C-shaped profiles.

21. The composite panel according to claim 1, further comprising a layer of rock wool adhered to the outer cladding plate.

22. The composite panel according to claim 1, further comprising two side edges, at least one of the two side edges being configured to cooperate with the side edge of an adjacent panel configured in a complementary manner.

23. The composite panel according to claim 22, wherein at least one of the two side edges includes a plaster tab made from a fire-resistant material extending along a side edge of an outer plaster plate, the plaster tab being arranged against an inner face of the outer plaster plate and extending beyond the side edge so that when the side edge of the panel cooperates with the complementary side edge of an adjacent panel, the plaster tab covers a seam between the respective outer plaster plates of the adjacent panels, the outer plaster plate being the inner wall plate.

24. The composite panel according to claim 22, wherein at least one of the side edges is formed by the polymer foam gripped between the outer cladding plate and the inner wall plate.

25. The composite panel according to claim 23, wherein the outer plaster plate includes, on an outer face, at least one thinner strip retracted towards an inside of the panel extending over an entire height of the plaster plate along a side edge.

26. The composite panel according to claim 22, wherein along at least one of the two side edges, the outer cladding extends laterally beyond the supporting structure and the inner wall plate, over a distance adapted to cover the side edge of an adjacent panel perpendicular to the composite panel, the outer cladding being covered on the inner face with the polymer foam configured to cooperate in a complementary manner with the side edge of the adjacent panel.

27. The composite panel according to claim 1, wherein along a lower edge of the panel, the outer cladding plate extends downwards beyond a lower edge of the supporting structure to form a covering skirt.

28. The composite panel according to claim 1, wherein the outer cladding plate includes at least one of (a) a metal cladding plate and (b) a lacquered galvanized steel cladding plate.

29. A method for making a composite panel, comprising:

arranging at least one inner wall plate, on which a supporting structure is placed or secured, in a molding frame;

positioning side crosspieces with shapes complementary to those of the side edges of the panel to be made;

placing polymer foam blocks on the inner wall plate or the supporting structure;

positioning at least one panel made from mineral wool in the supporting structure;

placing an outer cladding panel on the polymer foam blocks so that the outer cladding panel is positioned at a certain distance from the supporting structure;

inserting an assembly of the inner wall plate, the supporting structure, the side crosspieces, the polymer foam blocks, and the outer cladding panel into a conformator;

hot injecting the polymer foam; and stripping the panel after cooling wherein the composite panel comprises:

an outer cladding plate;

an inner wall plate;

a supporting structure provided between the outer cladding plate and the inner wall plate and at least partially embedded in a polymer foam, a first side of the supporting structure facing the inner wall plate is secured to the inner wall plate;

at least one panel made from mineral wool housed in the supporting structure;

wherein the polymer foam includes a polyurethane foam having a density greater than 30 $Kg/m^3$;

wherein the supporting structure includes a metal frame including at least two side posts, an upper crosspiece, and a lower crosspiece;

wherein the supporting structure is covered with the polyurethane foam on a second side facing the outer cladding plate, the polyurethane foam extending to lateral sides of the supporting structure, extending between the first and the second sides of the supporting structure; and wherein on a side opposite the supporting structure, the polyurethane foam is in contact with a layer of mineral wool which is glued to the outer cladding plate.

30. A composite panel for making a wall of a building, comprising:

an outer cladding plate;

an inner wall plate;

a supporting structure provided between the outer cladding plate and the inner wall plate and at least partially embedded in a polymer foam;

at least one panel made from mineral wool housed in the supporting structure;

two side edges, at least one of the two side edges being configured to cooperate with the side edge of an adjacent panel configured in a complementary manner wherein the polymer foam includes a polyurethane foam having a density greater than 30 $Kg/m^3$;

wherein the supporting structure includes a metal frame including at least two side posts, an upper crosspiece, and a lower crosspiece; and wherein at least one side edge is formed by the polymer foam gripped between the outer cladding plate and the inner wall plate.

* * * * *